US010269488B2

(12) United States Patent
Yi et al.

(10) Patent No.: US 10,269,488 B2
(45) Date of Patent: Apr. 23, 2019

(54) PREPARATION OF PERMANENT MAGNET MATERIAL

(71) Applicant: Tianhe (Baotou) Advanced Tech Magnet Co., Ltd., Baotou (CN)

(72) Inventors: Haibo Yi, Baotou (CN); Yi Dong, Baotou (CN); Shulin Diao, Baotou (CN); Yi Yuan, Baotou (CN); Shujie Wu, Baotou (CN); Cailing Sun, Baotou (CN); Juchang Miao, Baotou (CN); Ya Chen, Baotou (CN); Wenjie Yuan, Baotou (CN)

(73) Assignee: Tianhe (Baotou) Advanced Tech Magnet Co., Ltd. (CN)

( * ) Notice: Subject to any disclaimer, the term of this patent is extended or adjusted under 35 U.S.C. 154(b) by 534 days.

(21) Appl. No.: 15/060,188

(22) Filed: Mar. 3, 2016

(65) Prior Publication Data

US 2017/0062127 A1 Mar. 2, 2017

(30) Foreign Application Priority Data

Aug. 28, 2015 (CN) ..... 2015 1 0545815

(51) Int. Cl.

| | |
|---|---|
| ***H01F 41/02*** | (2006.01) |
| ***H01F 1/057*** | (2006.01) |
| ***B22F 3/12*** | (2006.01) |
| ***B22F 3/24*** | (2006.01) |
| ***B22F 3/26*** | (2006.01) |
| ***H01F 41/00*** | (2006.01) |
| ***C21D 6/00*** | (2006.01) |

(52) U.S. Cl.

CPC ..... *H01F 41/0266* (2013.01); *B22F 3/12* (2013.01); *B22F 3/24* (2013.01); *B22F 3/26* (2013.01); *C21D 6/00* (2013.01); *H01F 1/0577* (2013.01); *H01F 41/005* (2013.01); *H01F 41/0293* (2013.01); *B22F 2003/248* (2013.01)

(58) Field of Classification Search

CPC .. H01F 1/0577; H01F 41/0293; H01F 41/005; H01F 41/0266; C21D 6/00; B22F 3/26; B22F 3/24; B22F 3/12; B22F 2003/248

See application file for complete search history.

(56) References Cited

U.S. PATENT DOCUMENTS

| | | | | |
|---|---|---|---|---|
| 6,455,815 | B1 * | 9/2002 | Melgaard | F27B 5/14 148/108 |
| 2008/0247898 | A1 * | 10/2008 | Nakamura | B22F 3/24 419/9 |

FOREIGN PATENT DOCUMENTS

| | | | |
|---|---|---|---|
| CN | 101404195 | A | 4/2009 |
| CN | 101506919 | A | 8/2009 |
| CN | 101615459 | A | 12/2009 |

* cited by examiner

*Primary Examiner* — Daniel McCracken

(74) *Attorney, Agent, or Firm* — Lerner, David, Littenberg, Krumholz & Mentlik, LLP

(57) ABSTRACT

The present invention provides a method for preparing a permanent magnet material, the method comprising coating step and infiltrating step, wherein, coating a rare earth element-containing substance on the surface of a permanent magnet, the magnet having a thickness of 10 mm or less at least in one direction, then placing the magnet into a container, vacuuming to an atmospheric pressure of below 10 Pa, closing the passageway, and then heat treating the closed container. Using the method of the present invention enables the rare earth element to infiltrate homogeneously with a high permeability. In addition, the present invention may have a lower production cost, significantly increase coercive force of the permanent magnet material, but decrease the remanence very little.

9 Claims, No Drawings

PREPARATION OF PERMANENT MAGNET MATERIAL

CROSS REFERENCE TO RELATED APPLICATIONS

The present application claims priority from Chinese Patent Application No. 201510545815.2, filed Aug. 28, 2015, the disclosure of which is incorporated herein by reference.

TECHNICAL FIELD OF THE INVENTION

The present invention relates to a method for preparing a permanent magnet material, especially to a method for preparing a neodymium-iron-boron permanent magnet material with lower production cost, significantly increasing coercive force, but decreasing the remanence very little.

BACKGROUND OF THE INVENTION

With growing emphasis on reducing energy consumption worldwide, energy conservation and emission reduction have become the focus of attention of various countries. Compared to a non-permanent magnet motor, a permanent magnet motor can improve energy efficiency ratio. In order to reduce the energy consumption, neodymium-iron-boron (Nd—Fe—B) permanent magnet material has been used to produce the motors in the fields of air condition compressors, electric vehicle, hybrid vehicle or the like. Due to a high operating temperature of these motors, a higher intrinsic coercive force is required in all of these magnets. In addition, to increase magnetic flux density of the motors, the magnets were also required to have a higher magnetic energy product.

With conventional manufacture process of a neodymium-iron-boron magnet, it is difficult to satisfy both requirements of a high magnetic energy product and a high intrinsic coercive force. Even if such requirements are achieved, a large amount of rare earth elements Dy and Tb are still needed. However, the reserves of dysprosium (Dy) and terbium (Tb) around the world are finite, thus extensive use of Dy and Tb may cause prices to rise and accelerated depletion of the rare earth resources.

To improve the performance of the permanent magnet material and reduce the use of rare earth, a lot of researches have been done in the art. For instance, CN101404195A disclosed a method for preparing a rare earth permanent magnet by providing a sintered magnet body consisting of 12-17 at % of rare earth, 3-15 at % of B, 0.01-11 at % of metal element, 0.1-4 at % of O, 0.05-3 at % of C, 0.01-1 at % of N, and the balance of Fe, disposing on the surface of the magnet body a powder comprising an oxide, fluoride and/or oxyfluoride of another rare earth, and heat treating the powder-covered magnet body at a temperature below the sintering temperature in vacuum or in an inert gas, so that the other rare earth is absorbed in the magnet body. The characteristic of this method is to accomplish infiltration by disposing an oxide, fluoride and/or oxyfluoride of heavy rare earth, while the disadvantage thereof is to introduce harmful substance such as O and F. into the magnet Above all, after infiltration is completed, substances similar to oxide-scales on the surface of the magnet may arise, which need to be grinded, thus making the magnet materials being wasted.

As another example, CN101506919A disclosed a process for producing a permanent magnet, in which without deteriorating of the surface of the Nd—Fe—B sintered magnet, Dy is efficiently diffused in the crystal grain boundary phase to thereby attain effective enhancements of magnetization intensity and coercive force, and in which post-processes can be avoided. First of all, in a treatment chamber, the Nd—Fe—B sintered magnet and Dy are disposed with an interspace therebetween. Subsequently, in a reduced pressure, the treatment chamber is heated so that not only is the temperature of the sintered magnet raised to a given temperature but also Dy is evaporated to thereby attain supply of evaporated Dy atoms to the surface of the sintered magnet and adhesion therebetween. In this stage, the rate of Dy atoms supplied to the sintered magnet is controlled so that prior to the formation of any Dy layer on the surface of the sintered magnet, Dy is diffused in the crystal grain boundary phase of the sintered magnet. The characteristic of this method is to heat a substance containing heavy rare earth to form a vapor, while the disadvantage thereof is the expensive equipment cost and low evaporation efficiency. The actual comparative result shows that the effect of improving intrinsic coercive force ($H_{cj}$) of the latter method is inferior to the former one.

CN101615459A disclosed a method for improving magnetic performance of the sintered neodymium-iron-boron permanent magnet by a strip casting process with grain boundary diffusion of a heavy rare earth compound, wherein the infiltration treatment is prior to sintering. But the disadvantage of the method is that the heavy rare earth which has been enriched between boundary phases may disperse into the interior of the main phase during the high temperature sintering process after the magnet is infiltrated, thereby leading to equalization of heavy rare earth with a poor effect.

SUMMARY OF THE INVENTION

An objective of this invention is to provide a method for preparing a permanent magnet material. The method enables to improve the infiltration homogeneity and infiltration efficiency of the rare earth element significantly. A further objective of this invention is to provide a method for preparing a permanent magnet material, which may dramatically improve coercive force of the permanent magnet material, but decrease the remanence very little.

This invention provides a method for preparing a permanent magnet material, characterized in that, comprising steps as follows:

S2) coating step: coating a rare earth element-containing substance on the surface of a magnet, wherein, the magnet has a thickness of 10 mm or less at least in one direction; and S3) infiltrating step, comprising steps as follows:

S3-1) placing the magnet obtained from the coating step S2) into a container which has a passageway capable of carrying out a vacuuming operation;

S3-2) vacuuming by the passageway, until the container having an atmospheric pressure of below 10 Pa;

S3-3) closing the passageway in the continued vacuuming operation;

S3-4) heat treating the magnet closed in the container.

In accordance to the preparation method of the present invention, in the coating step S2), the rare earth element-containing substance is selected from:

a1) elementary substances of a rare earth element;

a2) alloys containing a rare earth element;

a3) compounds containing a rare earth element; or a4) mixture thereof.

In accordance to the preparation method of the present invention, in the coating step S2), the rare earth element is at least one selected from praseodymium, neodymium, yttrium, gadolinium, terbium, dysprosium, holmium, erbium, thulium, ytterbium and lutetium.

In accordance to the preparation method of the present invention, in the coating step S2), the magnet has a thickness of 5 mm or less at least in one direction.

In accordance to the preparation method of the present invention, in the infiltrating step S3), the container and the passageway are both made of quartz materials, and an inner diameter of the passageway is 3-15 mm.

In accordance to the preparation method of the present invention, in the step S3-1), at least two magnets obtained from the coating step S2) are neatly arranged with a surface having the largest area in each magnet as a contact surface, closely contacted with each other under the action of pressure, and then put into the container.

In accordance to the preparation method of the present invention, in the step S3-1), the pressure is at least 5 MPa.

In accordance to the preparation method of the present invention, preferably, in the step S3-2), carrying out the vacuuming operation by the passageway, until the container having an atmospheric pressure below 5 Pa; and in the step S3-4), the heat treatment temperature is 600-1200° C.; the heat treatment time is 0.5-10 hours.

In accordance to the preparation method of the present invention, preferably, the said method further comprising:

S1) magnet manufacturing step: manufacturing a magnet; and

S4) aging treatment step: performing an aging treatment on the magnet.

In accordance to the preparation method of the present invention, preferably, the magnet manufacturing step S1) comprising steps as follows:

S1-1) smelting step: smelting the neodymium-iron-boron raw material so that the smelted neodymium-iron-boron raw material forms a master alloy, wherein the master alloy has a thickness of 0.01-5 mm;

S1-2) powdering step: crushing the master alloy from the smelting step S1-1) into magnetic powder, wherein the magnetic powder has an average particle size D50 of 20 μm or less;

S1-3) shaping step: pressing the magnetic powder from the powdering step S1-2) into a green body for sintering under the action of an alignment magnetic field, wherein the green body has a density of 3.0 g/cm$^3$-5 g/cm$^3$; and S1-4) sintering step: sintering the green body from the shaping step S1-3) into a magnet, wherein the sintering temperature is 900-1300° C., wherein the sintering time is 0.5-10 hours, and the density of the magnet is 6.0 g/cm$^3$-9.0 g/cm$^3$.

The present invention manufactures a neodymium-iron-boron permanent magnet material through the following steps: coating a rare earth element-containing substance on the surface of a magnet with specific thickness, after using specific vacuum treatment, manufacturing the neodymium-iron-boron permanent magnet material via heat treatment and aging treatment. Using the manufacture method of the present invention enables the rare earth element to infiltrate homogeneously with high infiltration efficiency. In accordance to the preferred technical solution of the present invention, the preparation method of the present invention is capable of achieving the homogeneous infiltration of the rare earth element into the magnet, thereby dramatically improving the coercive force of a permanent magnet material, but decreasing the remanence very little. In accordance to a further preferred technical solution of the present invention, no aging treatment is performed in the magnet manufacturing step, so that production costs are saved.

DETAILED DESCRIPTION OF THE EMBODIMENTS

The present invention will be further explained in combination with the following specific embodiments, but the protection scope of the invention is not limited thereto.

The "remanence" in this invention refers to the value of the magnetic flux density at the point on the saturant magnetic hysteresis loop where the magnetic field strength is zero, and is commonly referred to as $B_r$ or $M_r$, with the unit of Tesla (T) or Gauss (Gs).

The "intrinsic coercive force" in this invention refers to the magnetic field strength when the magnetic field is monotonically decreased to zero from the saturant magnetization state of the magnet and reversely increased to make its magnetization strength decrease to zero along the saturant magnetic hysteresis loop, and is commonly referred to as $H_{cj}$ or ${}_MH_c$, with the unit of Oersted (Oe).

The "magnetic energy product" in this invention refers to the product of the magnetic flux density (B) of any point on the demagnetization curve and the corresponding magnetic field strength (H), and is commonly referred to as BH. The maximum value of BH is referred to as "maximum magnetic energy product" which is commonly referred to as $(BH)_{max}$, with the unit of Gauss• Oersted (GOe).

The "rare earth element" in this invention comprises but not limits to, praseodymium, neodymium, or "heavy rare earth element"; preferably, is "heavy rare earth element". The "heavy rare earth element" in this invention is also referred to as "Yttrium element", comprising nine elements of Yttrium (Y), Gadolinium (Gd), Terbium (Tb), Dysprosium (Dy), Holmium (Ho), Erbium (Er), Thulium (Tm), Ytterbium (Yb), Lutetium (Lu) and so on.

The "inert atmosphere" in this invention is referred to the atmosphere which does not react with neodymium-iron-boron magnet and not affect its magnetism. In the present invention, the "inert atmosphere" comprises the atmosphere comprising nitrogen or inert gases (helium, neon, argon, krypton, xenon).

The "vacuum" in this invention means absolute vacuum degree, a smaller value of absolute vacuum degree represents a higher vacuum degree.

The "average particle size D50" in this invention represents the equivalent diameter of the largest particles when the cumulative distribution in the particle size distribution curve is 50%.

The preparation method of permanent magnet material in the present invention comprises a coating step S2) and a infiltrating step S3). Preferably, the preparation method of the present invention also comprises a magnet manufacturing step S1) and an aging treatment step S4). Moreover, the magnet manufacturing step S1) is carried out prior to the coating step S2), and the aging treatment step S4) is carried out after the infiltrating step S3).

In the present invention, the magnet may be a sintered neodymium-iron-boron magnet or the other magnets, preferably be a sintered neodymium-iron-boron magnet. The following is set forth in terms of the sintered neodymium-iron-boron magnet.

Magnet Manufacturing Step S1)

Magnet manufacturing step S1) of the present invention is used to manufacture a sintered neodymium-iron-boron magnet. In the present invention, the magnet manufacturing step S1) preferably comprises steps as follows:

S1-1) smelting step: smelting the neodymium-iron-boron raw material so that the smelted neodymium-iron-boron raw material forms a master alloy;

S1-2) powdering step: crushing the master alloy from the smelting step S1-1) into magnetic powder;

S1-3) shaping step: pressing the magnetic powder from the powdering step S1-2) into a green body for sintering under the action of alignment magnetic field; and S1-4) sintering step: sintering the green body from the shaping step S1-3) into a sintered neodymium-iron-boron magnet.

In accordance to the preferred embodiments of the present invention, magnet manufacturing step S1) may also comprise the following steps:

S1-5) tempering step: tempering the sintered neodymium-iron-boron magnet; and/or S1-6) cutting step: cutting the sintered neodymium-iron-boron magnet.

Smelting Step S1-1)

In order to prevent the oxidation of the neodymium-iron-boron magnet raw material and the master alloy prepared therefrom, the smelting step S1-1) of the present invention is preferably carried out in vacuum or inert atmosphere. In the smelting step S1-1), there is no particular limit on the neodymium-iron-boron magnet raw material and the ratio thereof. The raw material and the ratio thereof that is known in the art can be used. In the smelting step S1-1), the smelting process preferably utilizes an ingot casting process or a strip casting process. The ingot casting process is that cooling and solidifying the smelted neodymium-iron-boron magnet raw material and producing an alloy ingot (master alloy). The strip casting process is that rapidly cooling and solidifying the smelted neodymium-iron-boron magnet raw material and spinning into alloy sheet (master alloy). In accordance to one preferred embodiment of the present invention, the smelting process utilizes the strip casting process. The inventors of the present application have surprisingly found that, it is possible for the strip casting process to avoid α-Fe which affects the uniformity of magnetic powder, and to avoid clumpy neodymium-rich phase, thereby beneficial to refining the grain size a main phase $Nd_2Fe_{14}B$ of the master alloy, in contrast to the casting process. The strip casting process of the present invention is preferably carried out in a vacuum melting and rapid-hardening furnace. The thickness of the alloy sheet (master alloy) of the present invention may be 0.01-5 mm, preferably 0.05-1 mm, more preferably 0.1-0.5 mm; the oxygen content is 2000 ppm or less, preferably 1500 ppm or less, and more preferably 1200 ppm or less.

Powdering Step S1-2)

In order to prevent the oxidation of the master alloy and the magnetic powder crushed therefrom, the powdering step S1-2) of the present invention is preferably carried out in vacuum or inert atmosphere. The powdering process S1-2) of the present invention preferably comprises the following steps:

S1-2-1) coarsely crushing step: crushing the master alloy into coarse magnetic powder with a larger particle size; and S1-2-2) milling step: milling the coarse magnetic powder obtained from coarsely crushing step S1-2-1) into fine magnetic powder (powder).

In the present invention, the average particle size D50 of the coarse magnetic powder obtained from the coarsely crushing step S1-2-1) is 500 μm or less, preferably 350 μm or less, more preferably 300-100 μm. In the present invention, the average particle size D50 of the fine magnetic powder obtained from the milling step S1-2-2) is 20 μm or less, preferably 10 μm or less, more preferably 1-5 μm.

In the coarsely crushing step S1-2-1) of the present invention, a mechanical crushing process and/or a hydrogen decrepitation process is applied to crush the master alloy into coarse magnetic powder. The mechanical crushing process is a process to crush the master alloy into coarse magnetic powder using a mechanical crushing device; the mechanical crushing device may be selected from jaw crusher or hammer crusher. The hydrogen decrepitation process includes the following steps: firstly making master alloy absorb hydrogen; initializing the master alloy crystal lattice expand through the reaction of master alloy and hydrogen and resulting in that the master alloy is crushed into coarse magnetic powder; then heating the coarse magnetic powder to carry out hydrogen desorption. In accordance to one preferred embodiment of the present invention, the hydrogen decrepitation process of the present invention is preferably carried out in a hydrogen decrepitation furnace. In the hydrogen decrepitation process of the present invention, the hydrogen absorption temperature is 50° C.-400° C., preferably 100° C.-300° C., and the hydrogen absorption pressure is 50-600 kPa, preferably 100~500 kPa, and the hydrogen desorption temperature is 500-1000° C., preferably 700-900° C.

In the milling step S1-2-2) of the present invention, a ball milling process and/or a jet milling process is applied to crush the coarse magnetic powder into fine magnetic powder. The ball milling process is a process to crush the coarse magnetic powder into fine magnetic powder using a mechanical ball milling device. The mechanical ball milling device may be selected from a rolling ball milling, a vibration ball milling or a high energy ball milling. The jet milling process is a process to exploit gas flow to make the coarse magnetic powder accelerated and hit each other and then crushed. The gas flow may be nitrogen flow, preferably high purity nitrogen flow. The high purity nitrogen flow may have N2 content of 99.0 wt % or more, preferably 99.9 wt % or more. The pressure of the gas flow may be 0.1-2.0 MPa, preferably 0.5-1.0 MPa, more preferably 0.6-0.7 MPa.

In accordance to one preferred embodiment of the present invention, firstly, crushing the master alloy into coarse magnetic powder by the hydrogen decrepitation process; and then, crushing the coarse magnetic powder into fine magnetic powder by jet milling process.

In accordance to a further embodiment of the present invention, the powdering step S1-2) may manufacture the magnetic powder by utilizing a rapid quenching process (Magnequench). The rapid quenching process such as those known in the art may be used, and will not be further explained here.

Shaping Step S1-3)

In order to prevent oxidation of magnetic powder, the shaping step S1-3) of the present invention is preferably carried out in vacuum or inert atmosphere. In the present invention, a magnetic powder pressing process is preferably a mould pressing process and/or an isostatic pressing process. The mould pressing process and isostatic pressing process such as those known in the art may be used, and will not be further explained here. In the shaping step S1-3) of the present invention, the direction of alignment magnetic field is aligned parallel or perpendicular to the pressing direction of the magnetic powder. There is no specific limitation on the strength of alignment magnetic field which depends on practical desires. In accordance to the preferred embodiment of the present invention, the strength of alignment magnetic field is at least 0.5 Tesla (T), preferably at least 0.7 T. In accordance to the preferred embodiment of the present invention, the strength of alignment magnetic field is below 3 T, preferably below 2.5 T. In accordance to a preferred embodiment of the present invention, the strength of alignment magnetic field is 0.7-2 T. The green body obtained from the shaping step S1-3) may have a density of 3.0 g/cm$^3$~5 g/cm$^3$, preferably 3.5 g/cm$^3$~4.5 g/cm$^3$.

Sintering Step S1-4)

In order to prevent oxidation of a green body for sintering, the sintered step S1-4) of the present invention is preferably carried out in vacuum or inert atmosphere. In accordance to the preferred embodiment of the present invention, the sintered step S1-4) is performed in a vacuum sintering furnace. The sintering temperature may be 900-1300° C., preferably 1000-1200° C., more preferably 1000-1080° C.; and the sintering time may be 0.5-10 hours, preferably 1-6 hours. The density of the sintered neodymium-iron-boron magnets obtained from the shaping step S1-4) may be 6.0 g/cm$^3$-9.0 g/cm$^3$, preferably 6.5 g/cm$^3$-8.0 g/cm$^3$.

Cutting Step S1-5)

In the cutting step S1-5) of the present invention, the cutting process adopts a slicing process and/or a wire cut electrical discharge machining. In the present invention, the sintered neodymium-iron-boron magnets are cut into magnets which may have a thickness, at least in one direction, of 10 mm or less, preferably 5 mm or less. Preferably, the direction of the thickness being 10 mm or less, preferably 5 mm or less is an alignment direction of the sintered neodymium-iron-boron magnets. In the present invention, the sintered neodymium-iron-boron magnets are cut into magnets which may have a thickness, at least in one direction, of 0.1 mm or more, more preferably 1 mm or more.

In the present invention, the magnet manufacturing step S1) is carried out preferably prior to the coating step S2). In the magnet manufacturing step S1), the aging treatment may or may not be performed. In order to save costs, it is preferred to perform the magnet manufacturing step S1) without aging treatment.

Coating Step S2)

The coating step S2) of the present invention is used to coat a rare earth element-containing substance on the surface of the sintered neodymium-iron-boron magnets. The rare earth element-containing substance of the present invention is selected from:

a1) elementary substances of a rare earth element;

a2) alloys containing a rare earth element;

a3) compounds containing a rare earth element; or a4) mixture thereof.

In the alloys containing a rare earth element (a2) of the present invention, in addition to the rare earth element, there are also other metal elements. Preferably, the other metal elements are at least one selected from aluminum, gallium, magnesium, tin, silver, copper, and zinc.

The compounds containing rare earth element (a3) of the present invention are inorganic or organic compounds containing a rare earth element. The inorganic compounds containing a rare earth element comprise but not limit to, oxides, hydroxides or inorganic acid salts of a rare earth element. The organic compounds containing a rare earth element comprise but not limit to, organic acid salts, alkoxides or metal complexes containing a rare earth element. In accordance to the preferred embodiments of the present invention, the compounds containing rare earth element of the present invention are halides of a rare earth element, such as fluorides, chlorides, bromides or iodides of a rare earth element.

In the rare earth element-containing substance of the present invention, the rare earth element is selected from praseodymium, neodymium or Yttrium element (heavy rare earth element), such as at least one selected from yttrium, gadolinium, terbium, dysprosium, holmium, erbium, thulium, ytterbium and lutetium. In accordance to the preferred embodiments of the present invention, the rare earth element is at least one of dysprosium or terbium.

The coating process utilized in the coating step S2) of the present invention may be any conventional coating process used in the art, such as wet coating, dry coating or the combination thereof may be used to perform coating.

The wet coating process of the present invention preferably is the following coating process or the combination thereof:

S2-1) dissolving a rare earth element-containing substance in the liquid medium to form a coating liquid in the form of solution, and coating with the coating liquid in the form of solution on the surface of the sintered neodymium-iron-boron magnet; or S2-2) dispersing the rare earth element-containing substance in the liquid medium to form a coating liquid in the form of suspension or emulsion, and coating with the coating liquid in the form of suspension or emulsion on the surface of the sintered neodymium-iron-boron magnet; or S2-3) providing coating liquid of the rare earth element-containing substance, immersing the sintered neodymium-iron-boron magnet into the coating liquid, and forming a coating film of the rare earth element-containing substance on the surface of the sintered neodymium-iron-boron magnet by chemical plating, electroplating, or electrophoresis.

In the coating process S2-1) and S2-2), there is no specific limitation on the coating means, any conventional coating process such as dip coating, brush coating, spin coating, spray coating, roller coating, screen printing or ink-jet printing may be used. The liquid medium of the coating liquid may be selected from water, organic solvents, or the combination thereof.

In the coating process S2-3), there is no specific limitation on the chemical plating, electroplating and electrophoresis process, any conventional process in the art may be used.

The dry coating process of the present invention preferably is the following coating process or the combination thereof:

S2-4) making the rare earth element-containing substance into powder, and coating the powder on the surface of the sintered neodymium-iron-boron magnet; or S2-5) depositing the rare earth element-containing substance on the surface of the sintered neodymium-iron-boron magnet by vapor deposition process.

The coating process S2-4) of the present invention preferably is selected from at least one of flame spraying process (thermal spraying process), fluidized bed process, electrostatic powder spraying process, electrostatic fluidized bed spraying process, vibrational electrostatic powder process. In accordance to the preferred embodiments of the present invention, the above mentioned coating process S2-4) may be used in the coating step S2) to carry out the dry coating.

The coating process S2-5) of the present invention preferably is selected from at least one of chemical vapor deposition (simply referred to as CVD) and physical vapor deposition (simply referred to as PVD).

Infiltrating Step S3)

The infiltrating step (i.e. diffusion step) S3) of the present invention preferably comprises steps as follows:

S3-1) placing the sintered neodymium-iron-boron magnet obtained from the coating step S2) into a container which has a passageway capable of carrying out a vacuuming operation;

S3-2) vacuuming by the passageway, until the container having an atmospheric pressure of below 10 Pa;

S3-3) closing the passageway in the continued vacuuming operation;

S3-4) heat treating the sintered neodymium-iron-boron magnet closed in the container.

In the present invention, the container and the passageway are both made of heat-resisting materials, so as to prevent melting during the subsequent heat treatment and/or aging treatment. Preferably, the heat-resisting materials are quartz. Preferably, the passageway has an inner diameter of 3-15 mm, preferably 5-12 mm, more preferably 6-10 mm. By using this structure, it may be more advantageous to carry out the closing operation on the passageway.

In the step S3-1), at least two sintered neodymium-iron-boron magnets obtained from the coating step S2) are neatly arranged with a surface having the largest area in each magnet as a contact surface, closely contacted with each other under the action of pressure, and then put into the container. The pressure in the present invention may be at least 5 MPa, preferably 5-1000 MPa, more preferably 50-500 MPa.

In the step S3-2), the container may have an atmospheric pressure of below 5 Pa, preferably below 1 Pa, further more preferably below 0.0001 Pa. The manner of closing the passageway may be soldering seal.

In the step S3-4), the heat treatment temperature may be 600-1200° C., preferably, 800-1000° C.; the heat treatment time is 0.5-10 hours, preferably 2-8 hours, more preferably 3-6 hours.

Aging Treatment Step S4)

The aging treatment step S4) of the present invention is used to perform aging treatment on the sintered neodymium-iron-boron magnet. In the present invention, the aging treatment temperature may be 300-900° C., preferably 400-600° C.; the time of aging treatment may be 0.5-10 hours, preferably 1-6 hours, more preferably 2-5 hours. In accordance to the preferred embodiment of the present invention, the aging treatment step S4) is carried out after the infiltrating step S3).

EXAMPLE 1

S1) magnet manufacturing step:

S1-1) smelting step: the raw materials in terms of weight percentage were formulated as follows: 23.5% Nd, 5.5% Pr, 2% Dy, 1% B, 1% Co, 0.1% Cu, 0.08% Zr, 0.1% Ga and the balance of Fe; the raw materials were placed in a vacuum melting and rapid-hardening furnace and smelted, to give an alloy sheets with an average thickness of 0.3 mm;

S1-2) powdering step: the alloy sheets obtained from the smelting step S1-1) were made to form coarse magnetic powder with a particle size of 300 μm by hydrogen absorption and hydrogen desorption in the hydrogen decrepitation furnace, and then the coarse magnetic powder were grinded in jet milling with nitrogen as media into fine magnetic powder with an average particle size D50 of 4.2 μm;

S1-3) shaping step: in a moulding press under protection of nitrogen, an alignment magnetic field of 1.8 T was applied to shape the fine magnetic powder obtained from the powdering step S1-2) to form the green body for sintering with the density of 4.3 g/cm$^3$;

S1-4) sintering step: the green body obtained from the shaping step S1-3) were placed in a vacuum sintering furnace to perform high temperature sintering, in order to form a sintered neodymium-iron-boron magnet, the vacuum degree in the vacuum sintering furnace is about 0.1 Pa, the sintering temperature is 1050° C., the sintering time is 5 hours, and the density of the obtained sintered neodymium-iron-boron magnet with size of 50 mm×40 mm×30 mm achieves 7.6 g/cm$^3$.

S1-5) cutting step: the sintered neodymium-iron-boron magnets obtained from the sintering step S1-4) were cut into magnets with size of 38 mm×23.5 mm×4 mm.

S2) coating step:

The terbium fluoride powder was coated on the surface of the sintered neodymium-iron-boron magnets obtained from the magnet manufacturing step S1) which have been cut.

S3) infiltrating step:

S3-1) the sintered neodymium-iron-boron magnets obtained from the coating step S2) were placed in a quartz container, and the quartz container was sealed through a quartz tube with a diameter of 7 mm;

S3-2) the quartz container was vacuumed through the quartz tube to an atmospheric pressure of below 1 Pa;

S3-3) the quartz tube was solder sealed under continued vacuuming;

S3-4) the sintered neodymium-iron-boron magnets were heat treated, the heat treatment temperature is 900° C., and the heat treatment time is 5 hours;

S4) aging treatment step:

Under vacuum conditions, the aging treatment was performed on the sintered neodymium-iron-boron magnets obtained from the infiltrating step S3), the aging treatment temperature is 500° C., and the aging treatment time is 3 hours.

EXAMPLE 2

The other conditions were the same as Example 1, except that the step S3-1) of Example 1 was changed to the following step: the sintered neodymium-iron-boron magnets obtained from the coating step S2) were neatly arranged in the direction of 4 millimeter thickness, the two ends of the sintered neodymium-iron-boron magnets which had been neatly arranged were applied a pressure of 500 MPa by a holder, and then the sintered neodymium-iron-boron magnets which had been applied a pressure were placed in a quartz container, the quartz container was sealed through a quartz tube with a diameter of 7 mm.

Comparative Example 1

The aging treatment was performed on the sintered neodymium-iron-boron magnets obtained from the sintering step S1-4) in the Example 1, the aging treatment temperature is 500° C., and the aging treatment time is 3 hours.

Comparative Example 2

The sintered neodymium-iron-boron magnets obtained from the coating step S2) in the Example 1 were placed in an graphite case under normal pressure, and heat treated, the heating treatment temperature is 900° C., and the heating treatment time is 5 hours; then performing the aging treatment, the aging treatment temperature is 500° C., and the aging treatment time is 3 hours.

Experimental Example 1

The sintered neodymium-iron-boron magnets obtained from Examples 1-2, and Comparative Examples 1-2 were cut into magnets of 9×9×4 mm, and then "remanence" ($B_r$) and "intrinsic coercive force" ($H_{cj}$) thereof were measured. The results thereof are shown in Table 1.

TABLE 1

| | Example 1 | Example 2 | Comparative Example 1 | Comparative Example 2 |
|---|---|---|---|---|
| $B_r$ (kGs) | 13.71 | 13.70 | 13.82 | 13.75 |
| $H_{cj}$ (kOe) | 26.52 | 27.48 | 18.25 | 25.85 |

The present invention is not limited by the above embodiments. All variations, modifications and replacements to the disclosed embodiments which are apparent to those skilled in the art and do not depart from the essence of the present invention fall in the scope of the present invention.

What is claimed is:

1. A method for preparing a permanent magnet material, comprising steps as follows:

S2) coating step: coating a rare earth element-containing substance on the surface of a magnet, wherein, the magnet has a thickness of 10 mm or less at least in one direction; and S3) infiltrating step, comprising steps as follows:

S3-1) placing the magnet obtained from the coating step S2) into a container which has a passageway capable of carrying out a vacuuming operation;

S3-2) vacuuming by the passageway, until the container having an atmospheric pressure of below 10 Pa;

S3-3) closing the passageway in the continued vacuuming operation; and

S3-4) heat treating the magnet closed in the container, wherein in the infiltrating step S3), the container and the passageway are both made of quartz materials, and an inner diameter of the passageway is 3-15 mm.

2. The preparation method according to claim 1, wherein in the coating step S2), the rare earth element-containing substance is selected from:

a1) elementary substances of a rare earth element;

a2) alloys containing a rare earth element;

a3) compounds containing a rare earth element; or a4) mixture thereof.

3. The preparation method according to claim 2, wherein in the coating step S2), the rare earth element is at least one selected from praseodymium, neodymium, yttrium, gadolinium, terbium, dysprosium, holmium, erbium, thulium, ytterbium and lutetium.

4. The preparation method according to claim 1, wherein in the coating step S2), the magnet has a thickness of 5 mm or less at least in one direction.

5. The preparation method according to claim 1, wherein in the step S3-1), at least two magnets obtained from the coating step S2) are arranged with a surface having the largest area in each magnet as a contact surface, closely contacted with each other under the action of pressure, and then put into the container.

6. The preparation method according to claim 5, wherein in the step S3-1), the pressure is at least 5 MPa.

7. The preparation method according to claim 1, wherein in the step S3-2), carrying out the vacuuming operation by the passageway, until the container having an atmospheric pressure of below 5 Pa; and in the step S3-4), the heat treatment temperature is 600-1200° C.; the heat treatment time is 0.5-10 hours.

8. The preparation method according to claim 1, further comprising:

S1) magnet manufacturing step: manufacturing a magnet; and

S4) aging treatment step: performing an aging treatment on the magnet.

9. The preparation method according to claim 8, wherein the magnet manufacturing step S1) comprises steps as follows:

S1-1) smelting step: smelting the neodymium-iron-boron raw material so that the smelted neodymium-iron-boron raw material forms a master alloy, wherein the master alloy has a thickness of 0.01-5 mm;

S1-2) powdering step: crushing the master alloy from the smelting step S1-1) into magnetic powder, wherein the magnetic powder has an average particle size D50 of 20 μm or less;

S1-3) shaping step: pressing the magnetic powder from the powdering step S1-2) into a green body for sintering under the action of an alignment magnetic field, wherein the green body has a density of 3.0 g/cm$^3$-5 g/cm$^3$; and S1-4) sintering step: sintering the green body from the shaping step S1-3) into a magnet, wherein the sintering temperature is 900-1300° C., the sintering time is 0.5-10 hours, the density of the magnet is 6.0 g/cm$^3$-9.0 g/cm$^3$.

* * * * *